US009683804B2

(12) United States Patent
Hartness

(10) Patent No.: US 9,683,804 B2
(45) Date of Patent: Jun. 20, 2017

(54) GUN HOLDER WITH BRUSH

(71) Applicant: Randy Steven Hartness, China Grove, NC (US)

(72) Inventor: Randy Steven Hartness, China Grove, NC (US)

( * ) Notice: Subject to any disclaimer, the term of this patent is extended or adjusted under 35 U.S.C. 154(b) by 65 days.

(21) Appl. No.: 14/505,354

(22) Filed: Oct. 2, 2014

(65) Prior Publication Data

US 2015/0097094 A1 Apr. 9, 2015

(51) Int. Cl.

| | |
|---|---|
| ***B60R 7/14*** | (2006.01) |
| ***F41A 29/02*** | (2006.01) |
| ***F41A 23/18*** | (2006.01) |
| *A47B 81/00* | (2006.01) |

(52) U.S. Cl.

CPC ..... *F41A 29/02* (2013.01); *F41A 23/18* (2013.01); *A47B 81/005* (2013.01)

(58) Field of Classification Search

CPC ..... A47B 81/005; F41A 17/44; F41A 23/18; F41A 29/02; F41C 33/08

See application file for complete search history.

(56) References Cited

U.S. PATENT DOCUMENTS 945,520 A * 1/1910 Greenwood ..... F41A 23/18 211/64
1,166,781 A * 1/1916 Parrish ..... A45F 5/021 224/193
1,579,553 A * 4/1926 Ludlow ..... F41A 23/18 224/191
4,271,969 A * 6/1981 Gnesa ..... F41A 23/18 211/64
5,012,965 A * 5/1991 Miller ..... F41C 33/0209 224/230
5,167,355 A * 12/1992 Hill ..... A45F 5/00 224/193
5,188,328 A * 2/1993 Thompson ..... F41A 23/18 211/64
5,503,276 A * 4/1996 Pierce ..... F41A 23/18 211/59.1
5,579,923 A * 12/1996 Hemmerlein ..... F41A 23/18 211/4
6,843,081 B1 * 1/2005 Painter ..... F41C 33/06 109/45
7,478,892 B2 * 1/2009 Punzel ..... A47B 81/005 211/64
7,735,253 B2 * 6/2010 Giebel ..... A47B 81/00 42/70.11
8,281,511 B1 * 10/2012 Ligard ..... F41A 17/02 211/64
8,533,876 B2 * 9/2013 Bonk ..... F41A 23/18 248/218.4
8,727,294 B1 * 5/2014 Harms ..... F41A 23/18 206/317
8,739,982 B2 * 6/2014 Werner ..... F41C 33/06 206/317

(Continued)

*Primary Examiner* — Bradley Duckworth
(74) *Attorney, Agent, or Firm* — Moore & Van Allen PLLC; W. Kevin Ransom

(57) ABSTRACT

Embodiments of the invention are directed to a gun holder assembly comprising: a plate; a rod comprising a first end detachably coupled to the plate and a second end configured for insertion into a gun barrel; and an engagement member detachably coupled to the second end of the rod and configured for engaging an interior surface of the gun barrel.

23 Claims, 10 Drawing Sheets

(56) References Cited

U.S. PATENT DOCUMENTS

| | | | | |
|---|---|---|---|---|
| 9,261,328 | B2 * | 2/2016 | Sitz | F41A 23/18 |
| 2008/0086927 | A1 * | 4/2008 | Wajdic | F41A 17/44<br>42/70.11 |
| 2012/0255979 | A1 * | 10/2012 | Sitz | F41C 33/0245<br>224/243 |
| 2012/0261368 | A1 * | 10/2012 | Klein | A47B 81/005<br>211/64 |
| 2016/0097610 | A1 * | 4/2016 | Hancosky | F41A 23/18<br>42/94 |

* cited by examiner

GUN HOLDER WITH BRUSH

CROSS REFERENCES TO OTHER RELATED APPLICATIONS

This application claims priority from and is a non-provisional patent application of U.S. Provisional Patent Application No. 61/887,786, filed on Oct. 7, 2013, and entitled "GUN HOLDER WITH BRUSH," the contents of which are hereby incorporated by reference in their entirety.

BACKGROUND

There is a need to store a gun as safely and efficiently as possible.

BRIEF SUMMARY

In one aspect, the present invention is directed to a gun holder assembly comprising: a first plate, wherein the first plate comprises at least one hole, wherein the at least one hole is configured to receive at least one coupling; a second plate, wherein the second plate is detachably coupled to the first plate, wherein the second plate comprises a tab, wherein the tab is substantially orthogonally coupled to the second plate and comprises at least one hole, wherein the at least one hole is configured to receive at least one rod; a rod, wherein the rod is detachably coupled to the hole of the tab, wherein the rod is configured to receive a gun barrel; a brush, wherein the brush is detachably coupled to the rod, wherein the brush is configured to receive a gun barrel.

In some embodiments, a gun holder assembly is provided. The gun holder assembly comprises a plate. The gun holder assembly further comprises a rod comprising a first end detachably coupled to the plate and a second end configured for insertion into a gun barrel. The gun holder assembly further comprises an engagement member detachably coupled to the second end of the rod and configured for engaging an interior surface of the gun barrel.

In some embodiments, the plate comprises a tab portion extending substantially orthogonally from the plate, wherein the tab portion comprises at least one hole configured to receive and detachedly couple to the first end of the rod.

In some embodiments, the at least one hole of the tab is threaded.

In some embodiments, the rod extends substantially orthogonally from the tab and is substantially parallel to the plate.

In some embodiments, the rod is mechanized with a motor to collapse into at least one of the rod, the tab, or the plate.

In some embodiments, the rod is a threaded dowel rod.

In some embodiments, the engagement member defines a diameter of at least a defined diameter of the rod.

In some embodiments, the engagement member comprises at least one of a bristle, a felt pad, a cotton pad, or a rubber pad.

In some embodiments, the plate comprises at least one hole configured to receive at least one coupling for mounting the assembly to a substantially vertical surface.

In some embodiments, the at least one coupling comprises at least one of a threaded screw, a nail, an anchor, an adhesive, a hinge, a post, or a hook.

In some embodiments, the at least one hole in said back plate is threaded.

In some embodiments, the plate is constructed from at least one of steel, metal, iron, an alloy, a plastic, a ceramic, or cement.

In some embodiments, the gun holder assembly comprises a second plate, wherein the second plate is detachably coupled to the first plate via flanged edges comprised in each of the plate and the second plate.

In some embodiments, the plate defines a width of at least a defined width of the second plate and a length of at least a defined length of the second plate.

In some embodiments, the plate is substantially parallel to the second plate when coupled with the second plate so as to define a cavity between the plate and the second plate.

In some embodiments, the flanged edges of each of the plate and the second plate are at least one of stamped, folded, bent, or molded.

In some embodiments, the second plate comprises at least one hole configured to receive at least one coupling and is configured to be coupled to a substantially vertical surface.

In some embodiments, the at least one coupling comprises at least one of a threaded screw, a nail, an anchor, an adhesive, a hinge, a post, or a hook.

In some embodiments, the at least one hole in said back plate is threaded.

In some embodiments, a gun holder assembly is provided. The gun holder assembly comprises a first plate comprising at least one hole configured to receive at least one coupling for mounting the assembly to a vertical surface. The gun holder assembly further comprises a second plate detachably coupled to the first plate and comprising a tab, wherein the tab is substantially orthogonally coupled to the second plate and comprises at least one hole configured to receive a first end of a rod. The gun holder assembly further comprises a rod, wherein a first end of the rod is detachably coupled to the hole of the tab and a second end of the rod is configured for insertion into a gun barrel. The gun holder assembly further comprises an engagement member detachably coupled to the second end of the rod and configured for engaging an interior surface of the gun barrel.

BRIEF DESCRIPTION OF THE DRAWINGS

Figure 1:
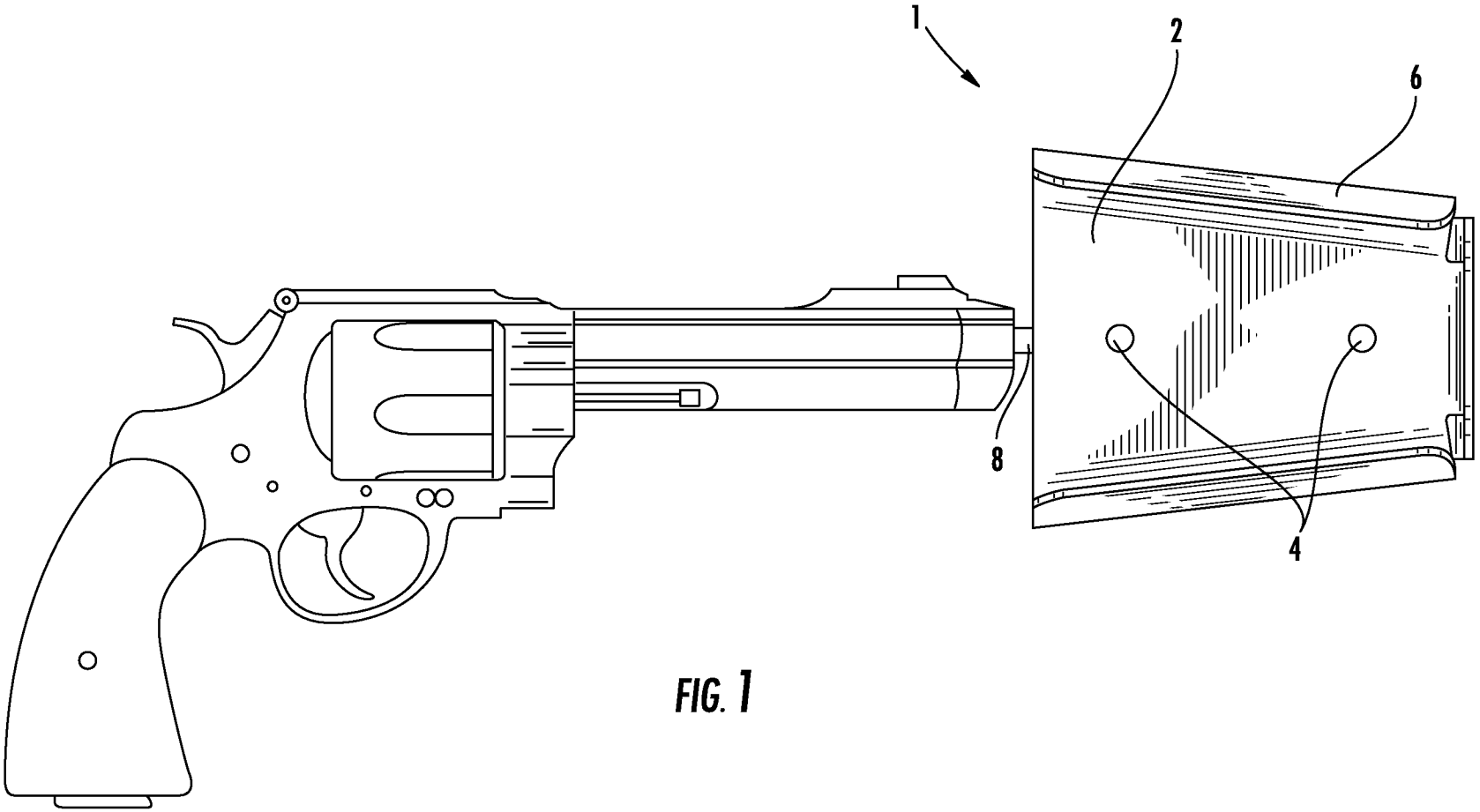
Figure 2:
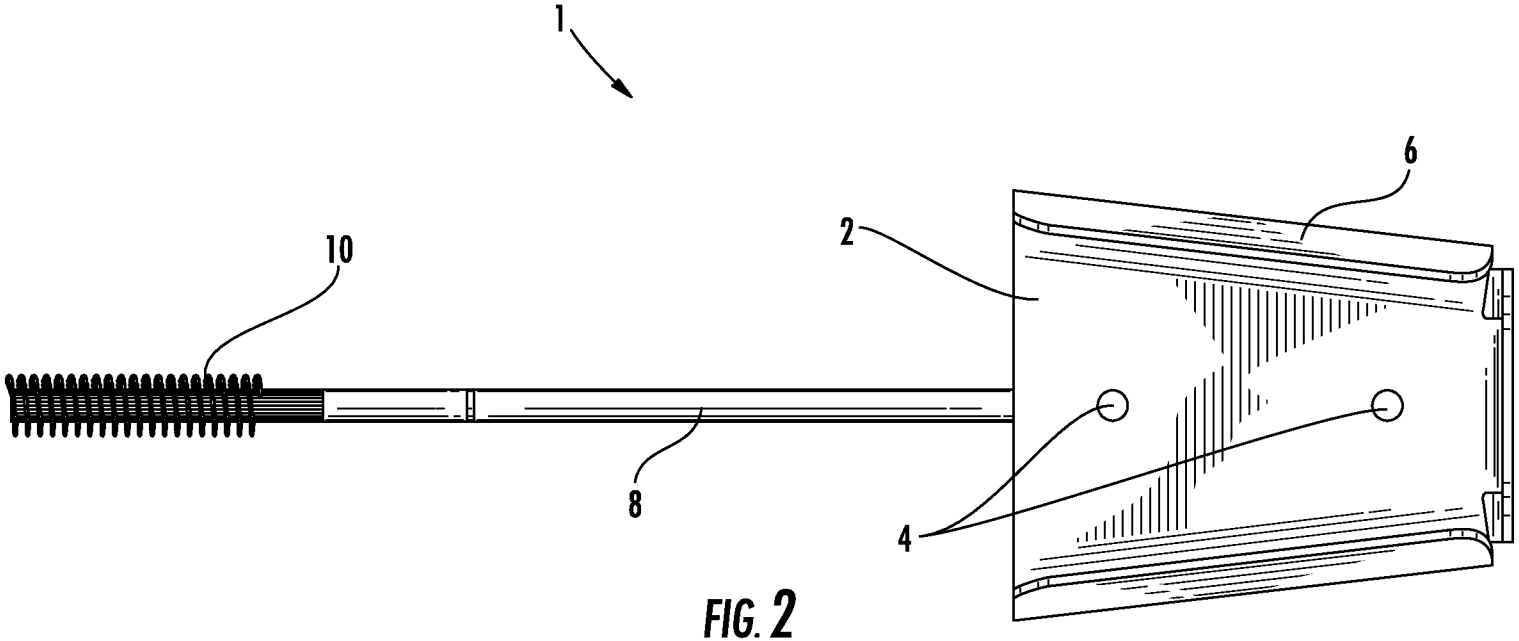
Figure 3:
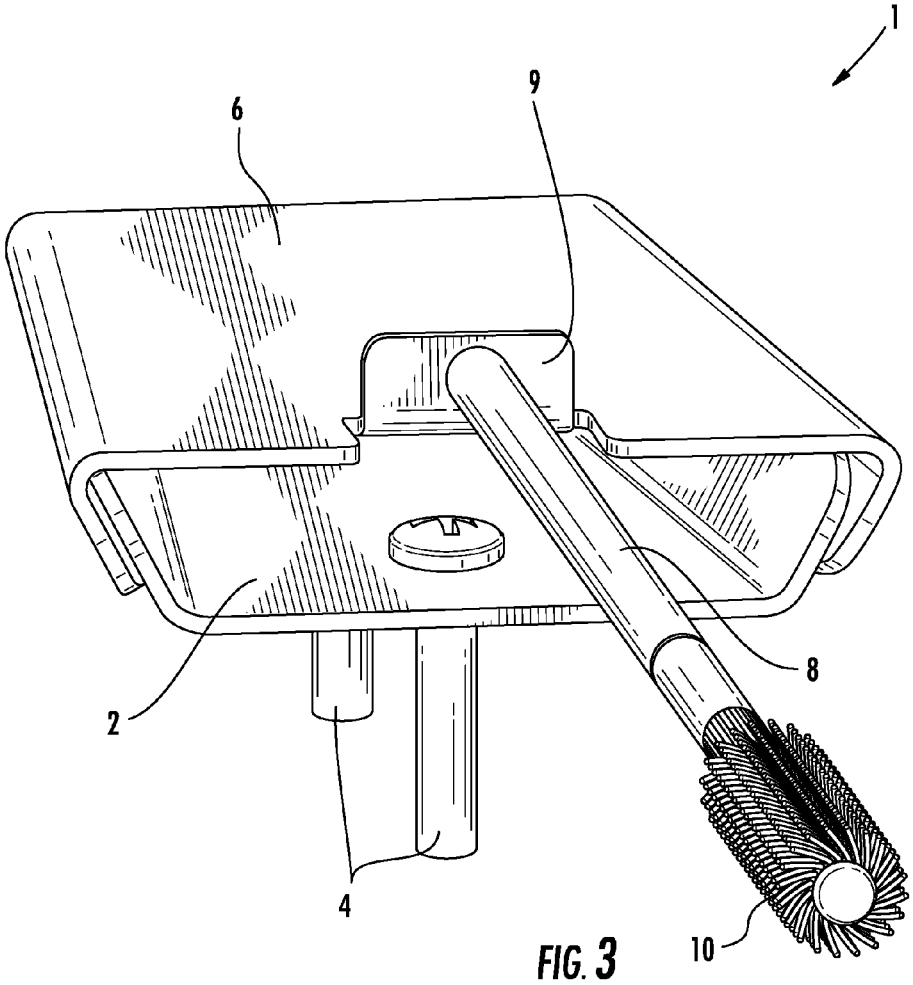
Figure 4:
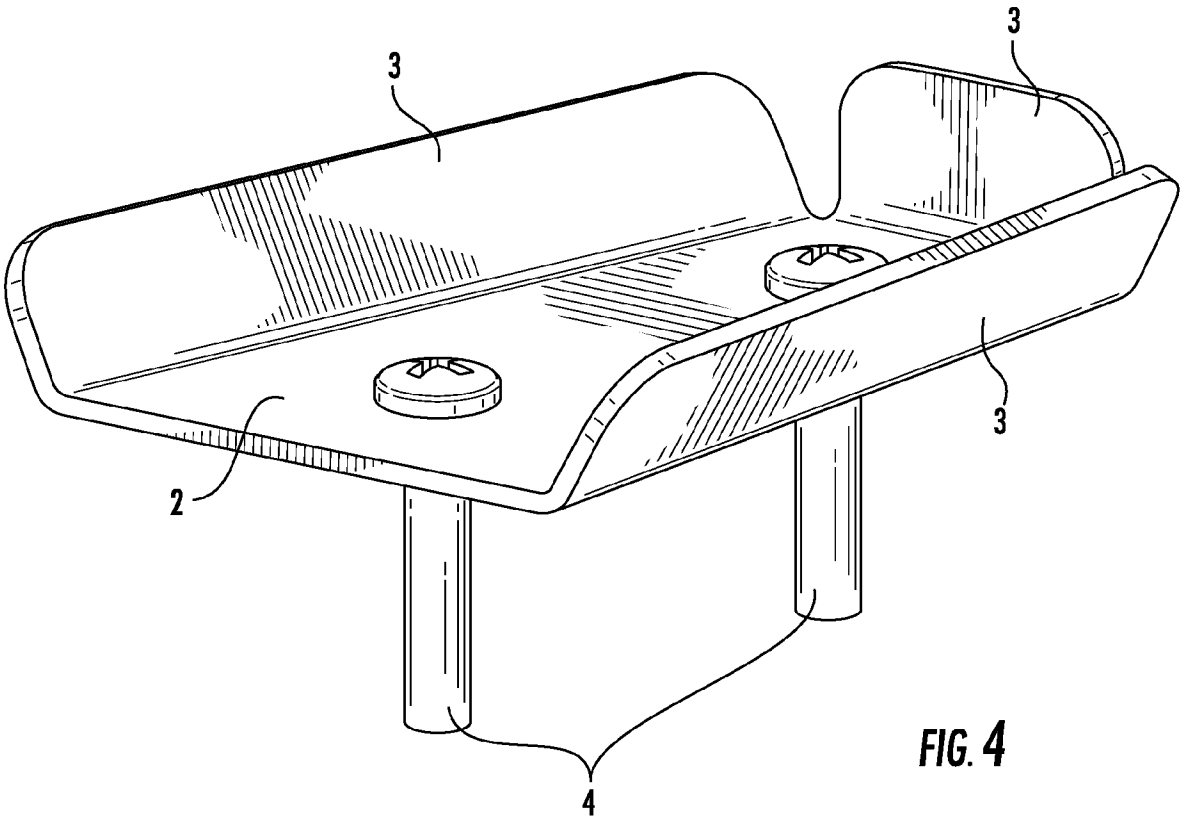
Figure 5:
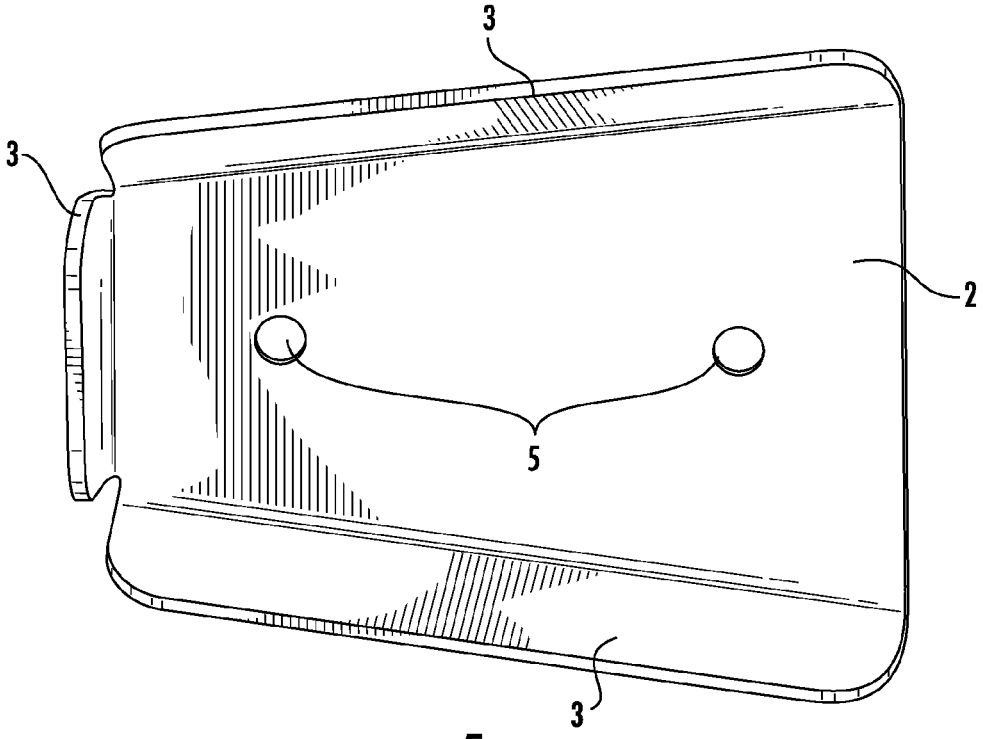
Figure 6:
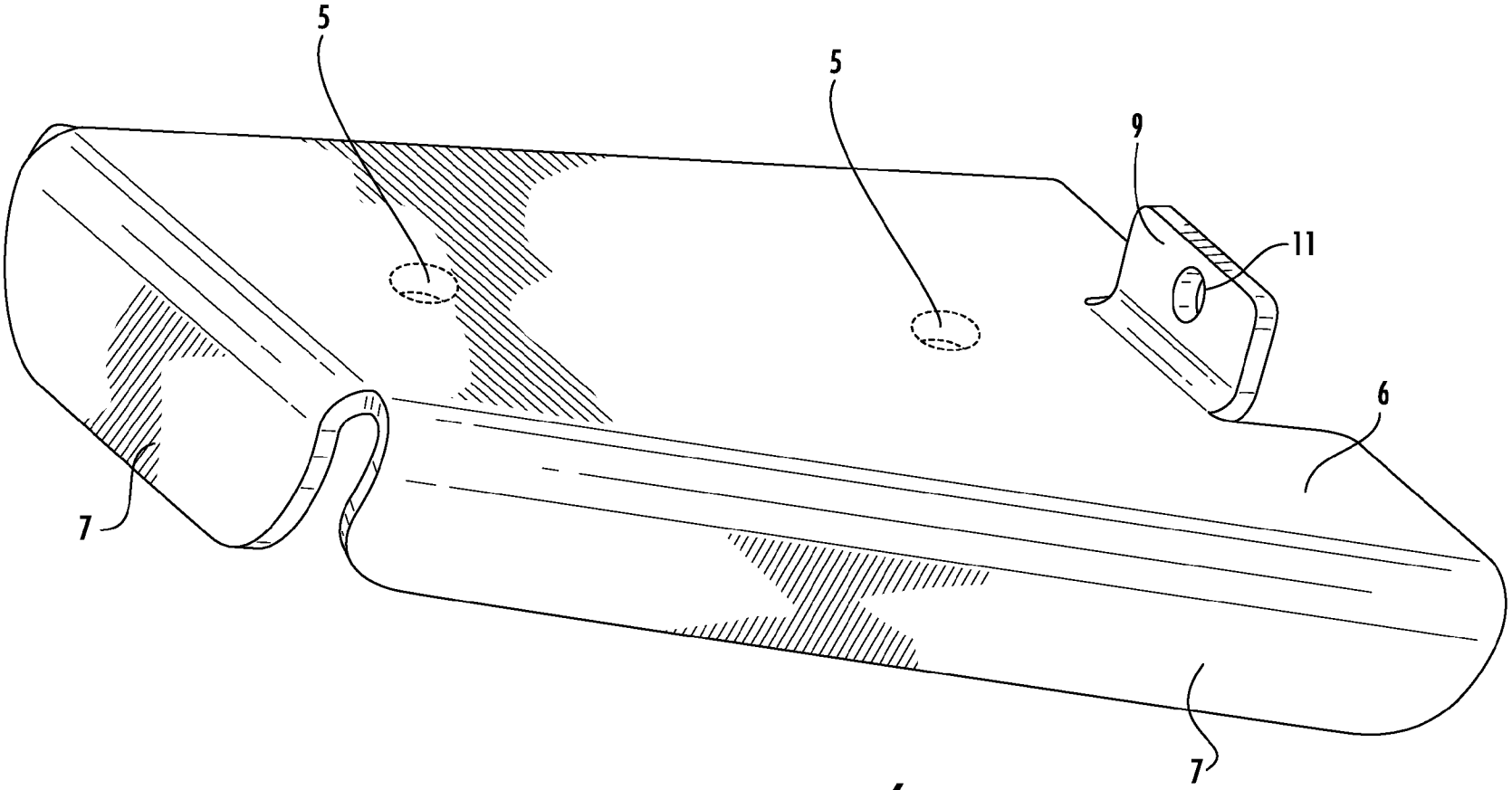
Figure 7:
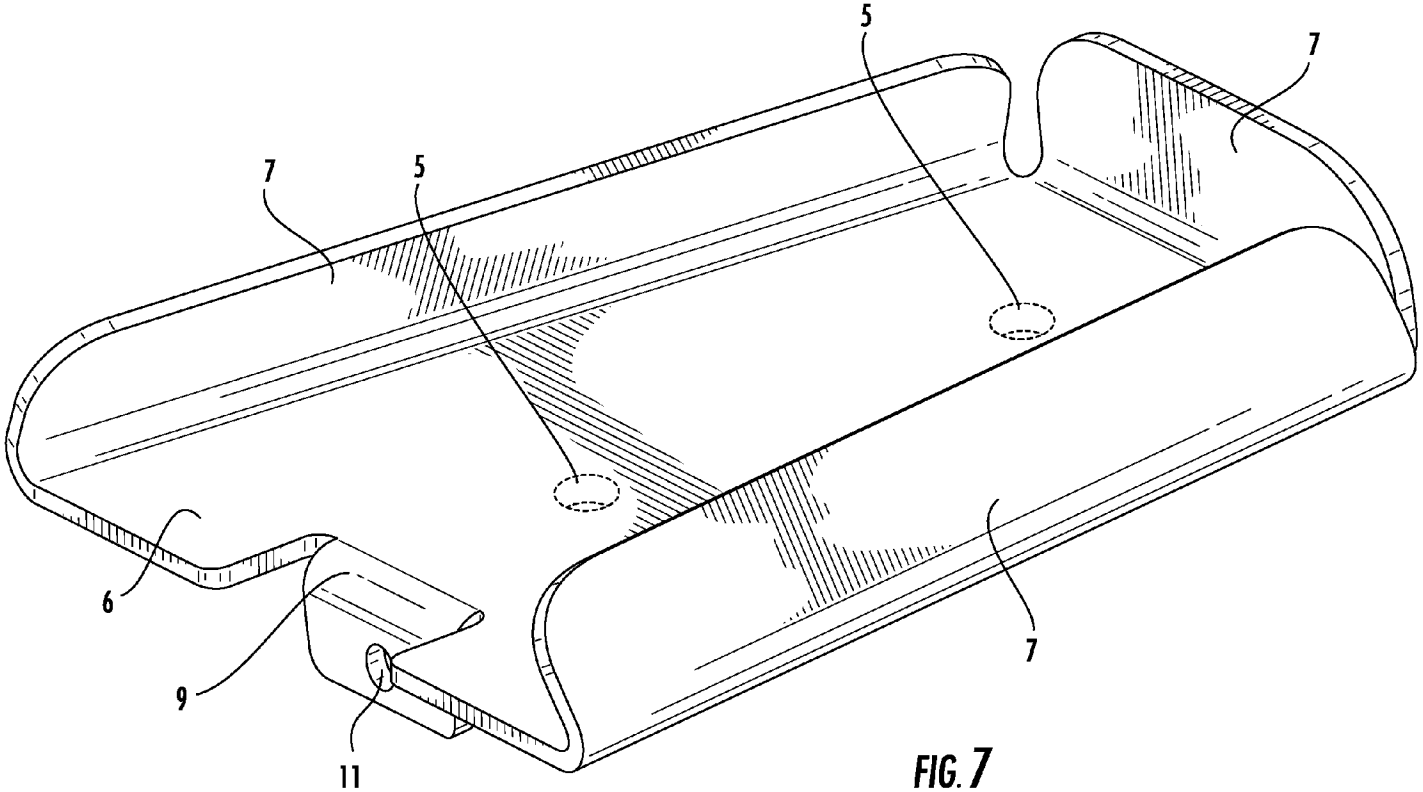
Figure 8:
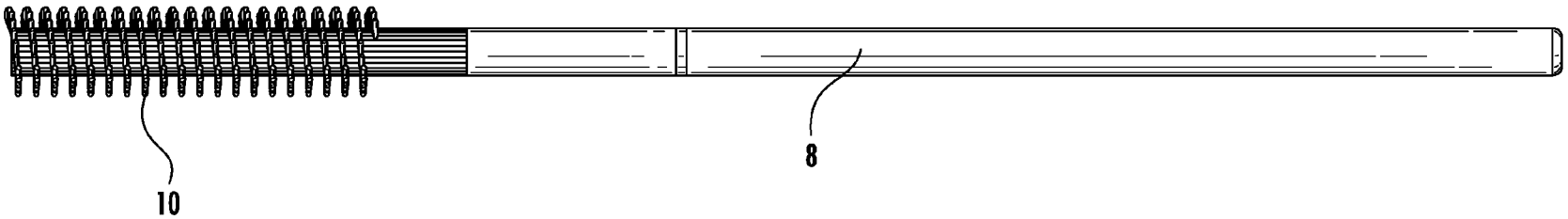
Figure 9:
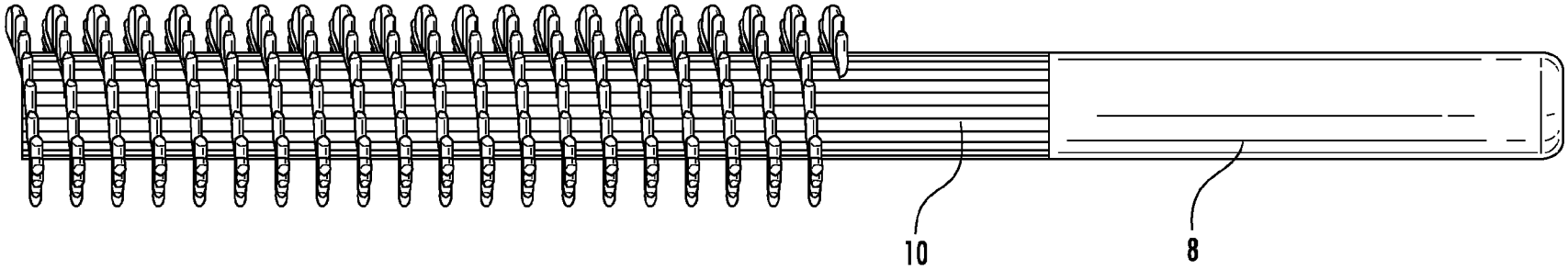
Figure 10:
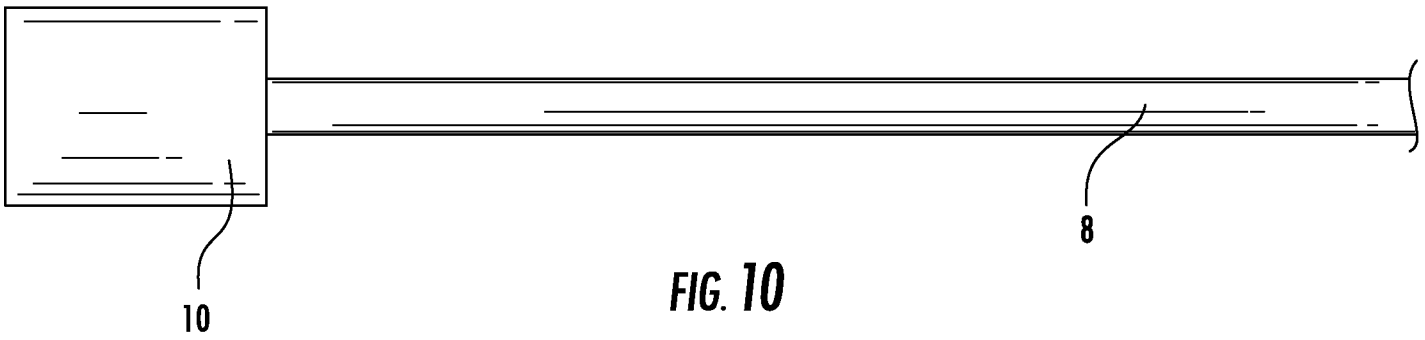

Having thus described embodiments of the invention in general terms, reference will now be made to the accompanying drawings, where:

FIG. 1 depicts a three-dimensional second view rendering of a prototype for a gun holder with a brush, in accordance with embodiments of the invention;

FIG. 2 depicts a three-dimensional side view rendering of a prototype for a gun holder with a brush, in accordance with embodiments of the invention;

FIG. 3 depicts a three-dimensional second view rendering of a back plate and couplings, in accordance with embodiments of the invention;

FIG. 4 depicts a three-dimensional side view rendering of a back plate, in accordance with embodiments of the invention;

FIG. 5 depicts a three-dimensional top view rendering of a back plate, in accordance with embodiments of the invention;

FIG. 6 depicts a three-dimensional second view rendering of a second plate, in accordance with embodiments of the invention;

FIG. 7 depicts a three-dimensional bottom view rendering of a second plate, in accordance with embodiments of the invention;

FIG. 8 depicts a three-dimensional side view rendering of a brush rod and a brush, in accordance with embodiments of the invention;

FIG. 9 depicts a three-dimensional side view rendering of a brush, in accordance with embodiments of the invention; and FIG. 10 depicts a three-dimensional side view rendering of a brush rod and a pad, in accordance with embodiments of the invention.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

In some embodiments, a "user" as used herein may operate the present invention. The user may be defined as any person interacting with the present invention.

As used herein, a "gun" may refer to any type of firearm, including a handheld weapon, a pistol, a rifle, a shotgun, a flare gun, or the like.

The present invention may include a gun holder assembly 1 that uniquely stores a gun. As shown in FIG. 1, the gun may be stored via the gun holder assembly 1 simply by sliding the rod into the barrel of the gun. Furthermore, the rod's end may include a brush, as depicted in FIGS. 2 and 3, which may clean the inside of the gun's barrel upon storage. Thus, the present invention may provide a novel approach for efficiently storing the gun while adequately maintaining the gun barrel's condition.

In some embodiments, the gun holder assembly 1 may be used to store the gun on a surface that is vertical, perpendicular to the ground, or in a similar configuration. For example, the gun holder assembly 1 may enable the user to store the gun on a wall or a door in efforts to save space when storing the gun. Furthermore, the gun holder assembly 1 may help the user maintain a high level of gun safety. The gun holder assembly 1 may be affixed at a height to where small children cannot reach the gun. In other embodiments, the gun holder assembly 1 may be affixed to a surface that is not perpendicular to the ground. Typically, the gun holder assembly 1 is crafted out of a durable solid material such as a metal alloy (aluminum, steel, iron, or the like), a plastic, wood, or the like. In alternative embodiments, the gun holder assembly 1 may be manufactured via a casting process, a three-dimensional printing process, or the like.

As FIGS. 2 and 3 show, the gun holder assembly 1 may define a plurality of components—a first plate 2, a coupling 4, a second plate 6, a rod 8, and a brush 10. These components may be operatively coupled to each other in a configuration as described herein that enables the user to effectively store a gun. The gun holder assembly 1 may also define a width, a length, a depth, or a height, which may vary depending on the type or size of the gun to be stored.

FIGS. 4 and 5 depict the first plate 2, which may define a width, a length, a depth, a height, or a plane. The first plate 2 may include at least one hole 5 (typically two holes 5 are included, as seen in FIG. 5) through which at least one coupling 4 may be inserted. For example, two anchored screw couplings 4 may be inserted through two threaded holes 5 of the first plate 2 to mount the gun holder assembly 1 on a vertical wall. In some embodiments, the hole 5 may be threaded. The coupling 4 shown in FIGS. 1 through 4 may include a threaded screw, a nail, a post, a fastener, a clip, a washer, a nut, or other structure that provides a stable connection to an adjacent surface.

Flanged sections 3, as depicted in FIGS. 4 and 5, may be included along one or more edges of the first plate 2. In some embodiments, these flanged sections 3 may be an extension of the first plate 2. In other embodiments, the flanged sections 3 may be independent of the first plate 2 and either permanently or detachably coupled to the first plate 2 via a coupling such as a weld or a hinge. In alternative embodiments, the flanged sections 3 may be adjustable. Typically, the purpose of the flanged sections 3 is to provide at least one surface that has been stamped, bent, or molded to a particular angle to enable coupling with the second plate 6.

FIGS. 6 and 7 depict the second plate 6. The second plate 6 may define a width, a length, a depth, a height, or a plane that is at least the width, the length, the depth, the height, or the plane of the first plate 2. This configuration may enable the user to slide the second plate 6 over the first plate 2 when mounting the gun holder assembly 1. Alternatively, the second plate 6 may define a width, a length, a depth, a height, or a plane that is less than the width, the length, the depth, the height, or the plane of the first plate 2 so as to enable the first plate 2 to slide over the second plate 6 when mounting the gun holder assembly 1. In some embodiments, the first plate 2 and the second plate 6 may refer to one another and may be used interchangeably throughout. The designated terms "first" and "second" when mentioning plates are used to identify a number of plates of the gun holder assembly 1 and do not necessarily specify a particular plate. For example, the first plate 2 may be mounted to a vertical surface and may couple to the second plate 6, which comprises a tab 9 configured to receive a rod 8. Conversely, the second plate 6 may be mounted to a vertical surface and may couple to the first plate 2, which comprises the tab 9 configured to receive the rod 8.

Typically, the second plate 6 and the first plate 2 are detachably coupled to one another via the flanged sections 3, 7 as depicted in FIGS. 1 through 3. In other embodiments, the second plate 6 and the first plate 2 may be permanently coupled or may be manufactured from one piece of material. Alternatively, the second plate 6 may include at least one hole 5 (typically two holes 5 are included, as illustrated by the dotted circles in FIGS. 6 and 7) through which at least one coupling 4 may be inserted. For example, two anchored screw couplings 4 may be inserted through two threaded holes 5 of the second plate 6 (similar to how two anchored screw couplings 4 are inserted through two threaded holes 5 of the first plate 2 as seen in FIGS. 3 and 4) to mount the gun holder assembly 1 on a vertical wall. In this way, the second plate 6 may be coupled directly to a vertical wall; therefore, the first plate 2 may not be required for mounting the gun holder assembly 1 to a vertical wall.

Flanged sections 7, as depicted in FIGS. 6 and 7, may be included along one or more edges of the second plate 6. In some embodiments, these flanged sections 7 may be an extension of the second plate 6. In other embodiments, the flanged sections 7 may be independent of the second plate 6 and either permanently or detachably coupled to the second plate 6 via a coupling, such as a weld. In alternative embodiments, the flanged sections 7 may be adjustable. Typically, the purpose of the flanged sections 7 is to provide at least one interlocking surface that has been stamped, bent, or molded to a particular angle to enable coupling of the first plate 2 to the second plate 6 as seen in FIGS. 1 through 3. Alternatively, the second plate 6 may include no flanged sections 7 so that, when the second plate 6 is mounted on and/or coupled directly to a vertical wall (i.e., when the first plate 2 is not required for mounting the gun holder assembly 1), the second plate 6 rests flush against the vertical wall surface.

The second plate 6 may also include a tab 9 that extends outward from the plane of the second plate 6 and is depicted in FIGS. 3, 6, and 7. In some embodiments, the tab 9 may extend orthogonally outward in relation to the length or the plane of the second plate 6. In other embodiments, the tab 9 may extend outward at another angle.

In some embodiments, the tab 9 may be an extension of the second plate 6 that has been stamped, bent, or molded to a particular angle. In other embodiments, the tab 9 may be independent of the second plate 6. The tab 9 may be either permanently or detachably coupled to the second plate 6 via a coupling, such as a weld. In alternative embodiments, the tab 9 may be adjustable.

The tab 9 may further include a hole 11 as shown in FIGS. 6 and 7. In some embodiments, the hole 11 may be threaded. In other embodiments, the hole 11 may not be threaded. In alternative embodiments, the hole 11 may be configured to be coupled to the rod 8.

The rod 8 shown in FIGS. 1, 2, 3, and 8 may be securely coupled to the tab 9 via a coupling such as a nut, a cap, a weld, a washer, a pin, or the like. In other embodiments, the rod 8 may be permanently or detachably coupled to the tab 9. The rod 8 may define a length, a width, a diameter, or a radius. The length, width, diameter, or radius may be adjustable or may vary depending on the size, type, or style of the gun that is to be stored. The rod 8 may also be motorized to retract or extend to reach a desired length. In alternative embodiments, the rod 8 may include a threaded dowel rod. Ultimately, the rod 8 may be inserted into the barrel of the gun to securely store the gun.

In some embodiments, the rod may include an engagement member 10 which may be coupled to an end of the rod 8 via a permanent or detachable coupling as shown in FIGS. 2, 3, and 8. The engagement member 10 seen in FIG. 9 may define a length, a width, a diameter, or a radius that may vary depending on the size, type, or style of the gun (and its associated barrel) that is to be stored. Typically, the length or the diameter of the engagement member 10 is matched with the length or diameter of the gun's barrel. This may ensure a secure fit between the gun and the gun holder assembly 1. In some embodiments, the engagement member 10 may include a brush, bristles, felt, cotton, or another type of pad, as shown in FIGS. 9 and 10. The engagement member 10 may be coupled to the rod 8 and inserted into the barrel of the gun for the purpose of cleaning the inside of the gun's barrel during storage. When inserted into the barrel of the gun, the engagement member 10 may be configured to engage an inside surface (e.g., an interior surface) of the gun barrel to effectively clean the inside surface of the gun barrel, remove any debris in the gun barrel, or the like.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A gun holder assembly comprising:

a first plate;

a rod comprising a first end detachably coupled to said first plate and a second end configured for insertion into a gun barrel of a selected gun; and an engagement member detachably coupled to said second end of said rod and configured for engaging and cleaning an interior surface of the gun barrel when said engagement member is inserted into said gun barrel, wherein a diameter of said engagement member has a selected size dimensioned to receive an inner diameter of the gun barrel of the selected gun to thereby engage with the gun barrel and ensure a secure fit between the gun barrel and the gun holder assembly.

2. The assembly of claim 1, wherein said first plate comprises a tab portion extending substantially orthogonally from said first plate, wherein the tab portion comprises at least one hole configured to receive and detachedly couple to the first end of the rod.

3. The assembly of claim 2, wherein the at least one hole of the tab is threaded, wherein said rod is threaded so as to couple said rod to said first plate via engagement with said tab, and wherein the amount that said rod extends from said first plate is based on an amount said rod is threaded into the hole of said tab.

4. The assembly of claim 2, wherein the rod extends substantially orthogonally from the tab and is substantially parallel to said first plate.

5. The assembly of claim 1, wherein said rod is a threaded dowel rod.

6. The assembly of claim 1, wherein said engagement member comprises at least one of a bristle brush, a felt pad, or a cotton pad.

7. The assembly of claim 1, wherein said first plate comprises at least one hole configured to receive at least one coupling for mounting the assembly to a substantially vertical wall surface.

8. The assembly of claim 7, wherein the at least one coupling comprises at least one of a threaded screw, a nail, an anchor, or a post.

9. The assembly of claim 7, wherein the at least one hole in said first plate is threaded.

10. The assembly of claim 1, wherein said first plate is constructed from at least one of steel, metal, iron, an alloy, a plastic, a ceramic, or cement.

11. The assembly of claim 1 comprising a second plate, wherein said second plate is detachably coupled to said first plate via flanged edges on each of said first plate and said second plate.

12. The assembly of claim 11, wherein said first plate defines a width of at least a defined width of said second plate and a length of at least a defined length of said second plate.

13. The assembly of claim 11, wherein said first plate is substantially parallel to said second plate when coupled with said second plate so as to define a cavity between said first plate and said second plate.

14. The assembly of claim 11, wherein the flanged edges of each of said first plate and said second plate are at least one of stamped, folded, bent, or molded.

15. The assembly of claim 11, wherein said second plate comprises at least one hole configured to receive at least one coupling and is configured to be coupled to a substantially vertical wall surface.

16. The assembly of claim 15, wherein the at least one hole in said first plate is threaded.

17. The assembly according to claim 11, wherein the flanged edges of a first side and a second side of the first plate extend at an obtuse angle from a first plane defined by the first plate, and wherein the flanged edges of a first side and a second side of the second plate extend at an acute angle from a second plane defined by the second plate.

18. The assembly of claim 1 further comprising a second plate, wherein both said first plate and said second plate each comprise flanged edges extending from the respective plates, wherein the flanged edges of said first and second plates interconnect with each other to thereby connect said first and second plates together.

19. The assembly of claim 1 further comprising a second plate, wherein both said first plate and said second plate each comprise flanged edges extending from first and second sides of the respective plates, wherein the flanged edges of said first and second plates slidably interconnect with each other to thereby connect said first and second plates together.

20. The assembly of claim 1, wherein said engagement member comprises bristles, felt, or cotton.

21. A gun holder assembly comprising:

a first plate comprising a tab, wherein the tab is substantially orthogonally coupled to said first plate and comprises at least one hole configured to receive a first end of a rod;

a second plate comprising at least one hole configured to receive at least one coupling for mounting said assembly to a surface, wherein said first plate is detachably coupled to said second plate;

a rod, wherein a first end of said rod is detachably coupled to the hole of the tab of said first plate and a second end of said rod is configured for insertion into a gun barrel of a selected gun; and an engagement member detachably coupled to the second end of said rod and configured for engaging and cleaning an interior surface of the gun barrel when said engagement member is inserted into said gun barrel, wherein a diameter of said engagement member has a selected size dimensioned to receive an inner diameter of the gun barrel of the selected gun to thereby engage and ensure a secure fit between the gun barrel and the gun holder assembly.

22. A gun holder assembly comprising:

a first plate defining a first plane and having a top portion, a bottom portion, a first side portion, and a second side portion, the bottom portion of the first plate comprising a tab portion extending substantially orthogonally from said first plate, wherein the tab portion comprises at least one hole;

a rod comprising a first end detachably coupled to said hole in said tab portion of said first plate and a second end configured for insertion into a gun barrel of a selected gun;

an engagement member detachably coupled to said second end of said rod and configured for engaging and cleaning an interior surface of the gun barrel when said engagement member is inserted into said gun barrel, wherein a diameter of said engagement member has a selected size dimensioned to receive an inner diameter of the gun barrel of the selected gun to thereby engage with the gun barrel and ensure a secure fit between the gun barrel and the gun holder assembly; and a second plate defining a second plane and having a top portion, a bottom portion, a first side portion, and a second side portion, the second plate comprising at least one hole within the second plane for connecting said second plate to a vertical wall surface such that the top portion of the second plate is oriented upward, wherein the top portions of both the first plate and the second plate each comprise top flanged edges extending from the top portions of the first plate and the second plate respectively, the top flanged edge of the first plate being configured to abut the top flanged edge of the second plate, wherein the first side portions of both the first plate and the second plate each comprise a first side flanged edge extending from the first side portions of the first plate and the second plate respectively, the first side flanged edge of the first plate being configured to slidably connect with the first side flanged edge of the second plate, and wherein the second side portions of both the first plate and the second plate each comprise a second side flanged edge extending from the second side portions of the first plate and the second plate respectively, the second side flanged edge of the first plate being configured to slidably connect with the second side flanged edge of the second plate, thereby allowing the second plate to be mounted on the vertical wall surface and the first plate to slide vertically downward over the second plate to detachably connect the first and second plates, thereby allowing the selected gun to hang from the gun holder assembly.

23. The assembly according to claim 22, wherein the first side flanged edge and the second side flanged edge of the first plate extend at an obtuse angle from the first plane, and wherein the first side flanged edge and the second side flanged edge of the second plate extend at an acute angle from the second plane.

* * * * *